US008430186B2

(12) United States Patent
Reid, Jr. et al.

(10) Patent No.: US 8,430,186 B2
(45) Date of Patent: Apr. 30, 2013

(54) SEALED CORE

(75) Inventors: Lennox E. Reid, Jr., Houston, TX (US); Carsten Sonne, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 385 days.

(21) Appl. No.: 12/773,105

(22) Filed: May 4, 2010

(65) Prior Publication Data

US 2010/0282515 A1 Nov. 11, 2010

Related U.S. Application Data

(60) Provisional application No. 61/176,574, filed on May 8, 2009, provisional application No. 61/187,126, filed on Jun. 15, 2009.

(51) Int. Cl.
*E21B 49/06* (2006.01)

(52) U.S. Cl.
USPC ..... 175/58; 175/78; 175/239; 175/249

(58) Field of Classification Search ..... 175/78, 175/79, 239, 240, 249–255, 58; 73/152.09, 73/152.11
See application file for complete search history.

(56) References Cited

U.S. PATENT DOCUMENTS

| | | | | |
|---|---|---|---|---|
| 4,466,495 | A * | 8/1984 | Jageler | 175/59 |
| 4,714,119 | A | 12/1987 | Hebert et al. | |
| 4,950,844 | A * | 8/1990 | Hallmark et al. | 175/59 |
| 5,033,551 | A * | 7/1991 | Grantom | 166/387 |
| 5,667,025 | A | 9/1997 | Haessly et al. | |
| 7,303,011 | B2 | 12/2007 | Reid et al. | |
| 7,347,284 | B2 * | 3/2008 | Arian et al. | 175/78 |
| 7,500,388 | B2 | 3/2009 | Fujisawa et al. | |
| 2008/0066534 | A1 | 3/2008 | Reid et al. | |
| 2009/0025941 | A1 | 1/2009 | Iskander et al. | |

FOREIGN PATENT DOCUMENTS

| | | |
|---|---|---|
| WO | 2008098359 | 8/2008 |

* cited by examiner

*Primary Examiner* — Giovanna Wright
(74) *Attorney, Agent, or Firm* — John Vereb; Cathy Hewitt

(57) ABSTRACT

An apparatus comprising a sidewall coring tool configured to obtain a plurality of sidewall formation cores from a sidewall of a wellbore extending into a subterranean formation, wherein the sidewall coring tool comprises a core catching tube configured to store the plurality of sidewall formation cores therein, wherein the core catching tube comprises a fluid port configured to allow evacuation of fluid from the core catching tube as each of the plurality of sidewall formation cores is introduced therein, and wherein the core catching tube, including the fluid port, is configured to be sealed downhole without removing the sidewall coring tool from the wellbore.

20 Claims, 9 Drawing Sheets

SEALED CORE

CROSS-REFERENCE/PRIORITY TO RELATED APPLICATIONS

This application claims the benefit of U.S. Provisional Application No. 61/176,574, entitled "SEALED CORE," filed May 8, 2009, the entire disclosure of which is hereby incorporated herein by reference.

This application also claims the benefit of U.S. Provisional Application No. 61/187,126, entitled "SEALED CORE," filed Jun. 15, 2009, the entire disclosure of which is hereby incorporated herein by reference.

BACKGROUND OF THE DISCLOSURE

Cores extracted from a formation sidewall may include trapped formation fluid. The cores are extracted from the formation at downhole condition (usually at pressures above 1,000 psi, and perhaps up to 30,000 psi), and brought to the surface for analysis, for example, in a surface laboratory. As the cores are brought to the surface, they can experience a decompression from downhole pressure to surface pressure.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
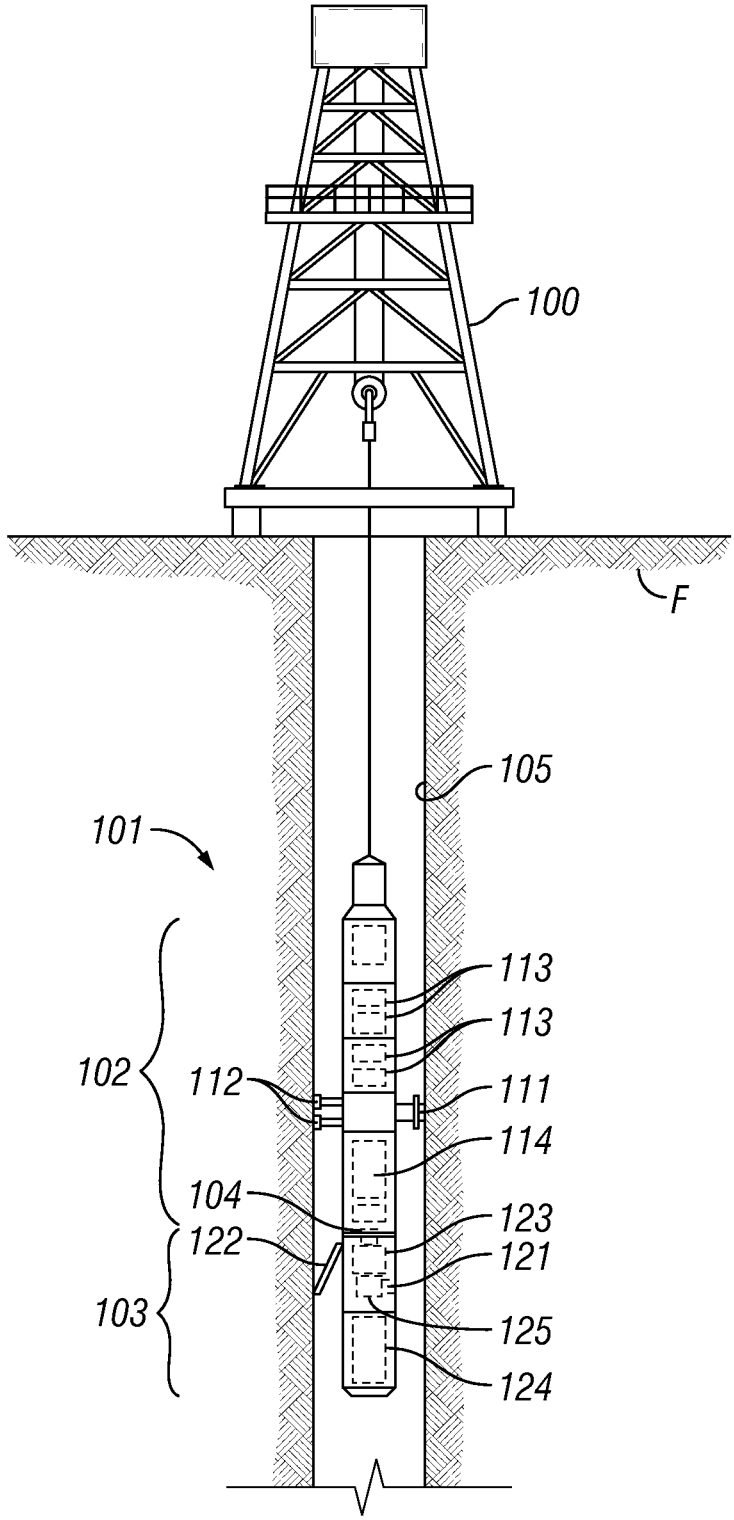
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

A downhole tool positionable in a wellbore penetrating a subterranean formation is disclosed in U.S. Pat. No. 7,303,011, the entirety of which is hereby incorporated herein by reference. The downhole tool includes a housing, a coring bit and a sample chamber. The coring bit is disposed in the housing and is extendable therefrom for engaging a wellbore wall. The sample chamber stores at least two formation samples obtained with the coring bit and includes at least two portions for separately storing the formation samples.

A method of preserving hydrocarbon samples obtained from an underground formation is disclosed in U.S. Patent Application Pub. No. 2008/0066534, the entirety of which is hereby incorporated herein by reference. The method includes delivering a coring tool to the formation, obtaining from the formation a core sample having a hydrocarbon therein, capturing the core sample in a container, sealing the container downhole with the hydrocarbon contained therein, and storing the sealed container in the tool.

A sidewall coring tool according to one or more aspects of the present disclosure may comprise a core catching tube for storing one or more formation cores containing a formation fluid. Such core catching tube may comprise at least a fluid port configured to evacuate a fluid located in the core catching tube as the one or more cores are introduced therein. The at least one fluid port may be sealed downhole. The core catching tube may be provided with a cushion configured to maintain the pressure in the core catching tube once the at least one fluid port is sealed. The core may be brought to the surface in the sealed core catching tube. At the surface, the formation fluid contained in the formation cores may be extracted from the core catching tube. Properties of the formation fluid may then be analyzed.

One or more aspects of the present disclosure may reduce the risk of explosive decompression of gasses trapped in the cores (e.g., in pores of the cores). One or more aspects of the present disclosure may also or alternatively limit or prevent the loss of formation fluid trapped in the core (e.g., in the pores of the cores). One or more aspects of the present disclosure may also or alternatively limit or prevent invasion of the core pores by wellbore fluids.

The apparatus and methods disclosed herein may be used in both "wireline", "on pipe", and "while-drilling" applications. Thus, while one or more aspects of the present disclosure are described in reference to a wireline implementation, those skilled in the art will readily recognize that one or more of such aspects may also be application or readily adaptable to while-drilling applications, such as measurement-while-drilling (MWD), logging-while-drilling (LWD), and/or wired-drill-pipe (WDP), among others.

FIG. 1 is a schematic view of an apparatus 101 deployed in a wellbore 105 from a rig 100 according to one or more aspects of the present disclosure. The apparatus 101 comprises a coring tool 103, which itself may comprise a coring assembly 125 with a coring bit 121 and its associated actuation mechanisms 123, and a storage area 124 for storing core samples. The storage area 124 is configured to receive sample cores. At least one brace arm 122 may be provided to anchor the apparatus 101 and/or tool 103 in the borehole when the coring bit 121 is functioning.

The apparatus 101 may further comprise additional systems for performing other functions. One such additional system is illustrated in FIG. 1 as a formation testing tool 102 that is operatively connected to the coring tool 103 via a field joint 104. The formation testing tool 102 may comprise a probe 111 configured to extend from the formation testing tool 102 to be in fluid communication with the formation F. The formation testing tool 102 and/or other portion of the apparatus 101 may comprise back up pistons 112 configured to assist in urging the probe 111 into contact with the sidewall of the wellbore and to stabilize the tool 102 in the borehole. The formation testing tool 102 may comprise a pump 114 configured to pump sampled formation fluid through the tool, as well as sample chambers 113 configured to store such fluid samples. The locations of these components are only schematically shown in FIG. 1, and may be provided in locations within the tool other than as illustrated. Other components may also be included, such as a power module, a hydraulic module, a fluid analyzer module, and other devices.

The apparatus of FIG. 1 is depicted as having multiple modules operatively connected together. The apparatus, however, may also be partially or completely unitary. For example, as shown in FIG. 1, the formation testing tool 102 may be unitary, with the coring tool 103 housed in a separate module that is operatively connected to the formation testing tool 102 by the field joint 104. Alternatively, the coring tool may be unitarily included within the overall housing of the apparatus 101.

Downhole tools often include several modules (e.g., sections of the tool that perform different functions). Additionally, more than one downhole tool or component may be combined on the same tool string to accomplish multiple downhole tasks without requiring removal from the borehole. Such modules may be connected by field joints, such as the field joint 104. For example, one module of a formation testing tool typically has one type of connector at its top end and a second type of connector at its bottom end. The top and bottom connectors are made to operatively mate with similar connectors of adjoining modules. By using modules and tools with similar arrangements of connectors, all of the modules and tools may be connected end to end to form the tool string. A field joint may provide an electrical connection, a hydraulic connection, and/or a flow line connection, depending on the requirements of the tools in the tool string. An electrical connection may provide power and/or communication capabilities.

In practice, a downhole tool may comprise several different components, some of which may be comprised of two or more modules (e.g., a sample module and a pump out module of a formation testing tool). In this disclosure, "module" is used to describe any of the separate tools or individual tool modules that may be connected in a tool string. "Module" describes any part of the tool string, whether the module is part of a larger tool or a separate tool by itself. In this disclosure, the term "tool string" may be used to prevent any confusion with the individual tools that make up the tool string (e.g., a coring tool, a formation testing tool, and a resistivity imaging tool may all be included in a tool string).

Figure 2A:
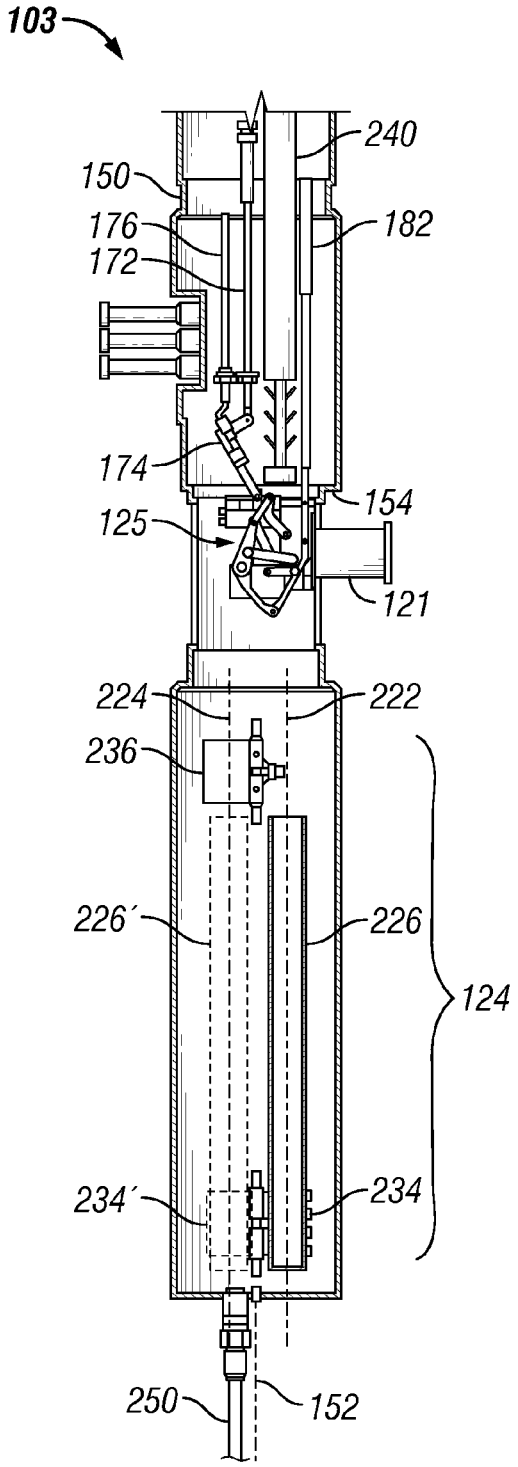
FIGS. 2A and 2B are schematic views of apparatus according to one or more aspects of the present disclosure.
Figure 2B:
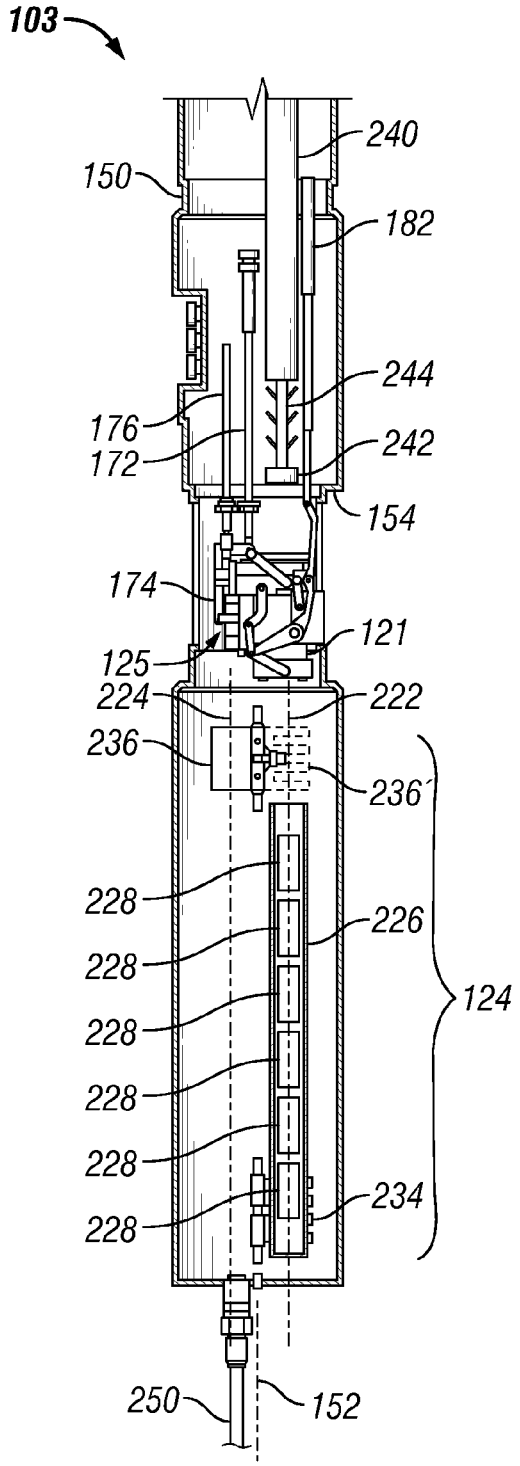

The coring tool 103 is shown in greater detail in FIGS. 2A and 2B. The coring tool 103 comprises a tool housing 150 extending along a longitudinal axis 152. The tool housing 150 comprises a coring aperture 154 through which core samples are retrieved from the sidewall of the wellbore. The coring assembly 125 and storage area 124 are disposed within the tool housing 150.

The coring assembly 125 may be rotatably coupled to the tool housing 150. The coring bit 121 is mounted within the coring assembly 125 such that it may slide axially and rotate within the coring assembly 125. A coring motor is also mounted on coring assembly 125 and is operably connected to the coring bit 121 to rotate the bit. The coring motor may be implemented with a hydraulic motor, although other types of motor or mechanisms capable of rotating the coring bit 121 may be used.

A first or rotation piston 172 is operably coupled to the coring assembly 125 to rotate the coring assembly 125 between the coring position (illustrated in FIG. 2A) and the eject position (illustrated in FIG. 2B). As shown in FIGS. 2A and 2B, the rotation piston 172 is coupled to the coring assembly 125 by an intermediate link arm 174. As the piston 172 moves from a retracted position shown in FIG. 2A to an extended position shown in FIG. 2B, the coring assembly 125 rotates about rotation link arms from the coring position to the eject position. The intermediate link arm 174 may also provide convenient means for communicating hydraulic fluid from one or more hydraulic flow lines 176 to the coring motor.

A series of pivotably coupled extension link arms is coupled to a portion, such as the thrust ring, of the coring bit 121 to provide a substantially constant weight on bit. The series of extension link arms may be coupled to a second or extension piston 182. With the series of extension links, movement of the second piston 182 will actuate the coring bit 121 between an extended position as shown in FIG. 2A and a retracted position as shown in FIG. 2B. As the second piston 182 moves toward an extended position, it drives the coring bit 121 to the extended position. The amount of lost motion in the series of extension link arms may be kept essentially constant to transfer an almost constant percentage of the piston force to the coring bit 121. As a result, the series of extension link arms produces a more constant weight on bit across the entire range of travel of the coring bit 121.

From the foregoing, it will further be appreciated that extension of the coring bit 121 is substantially decoupled from the rotation of the coring assembly 125. The first piston 172 and intermediate link arm 174 are independent from the second piston 182 and series of extension link arms used to extend the coring bit 121. Accordingly, the first and second pistons 172, 182 may be operated substantially independent of one another, which may allow for additional functionality of the coring tool 103. For example, and notwithstanding any clearance issues with the tool housing 150 or other tool structures, the coring bit 121 may be extended at any time regardless of the position of the bit housing 156. Consequently, core samples may be obtained along a diagonal plane when the coring assembly 125 is held at an orientation somewhere between the eject and coring positions described above.

While the first and second pistons 172, 182 may be operated independently, operation of one of the pistons may impact or otherwise require cooperation of the other piston. During rotation of the coring assembly 125, for example, the second piston 182 may be de-energized or controlled in a manner (such as by dithering) to minimize any resistance the second piston 182 might exert against such rotation. The primary functions of the rotation of the coring assembly 125 and the extension of the coring bit 121, however, may be achieved independent of one another.

The coring tool 103 further comprises a system for efficiently handling and storing multiple core samples. Accordingly, the storage area 124 may be configured to have at least first and second storage columns 222 and 224, at least one storage column being sized to receive a core catching tube 226 adapted to hold core samples 228. In the illustrated embodiment, one core catching tube 226 is shown holding six cores 228. However, the core catching tube may be sized to hold more or less than six cores depending on the dimensions of the storage area 124. For example, each core catching tube may be sized to hold at least ten cores 228.

Shifters 234, 236 may be provided to move the core catching tube 226, among other components, between the storage columns 222, 224. In the illustrated embodiment, the shifter 234 includes fingers adapted to grip an exterior of the core catching tube 226. The shifter 234 may rotate from a first position in which the core catching tube 226 registers with an axis of the first storage column 222, to a second position (as indicated as 234' in FIG. 2A) in which the core catching tube registers with an axis of the second storage column 224 (as indicated as 226' in FIG. 2A). The other shifter 236 is similarly rotatable between a first position in which the shifter 236 registers with an axis of the second storage column 224 and second position in which it registers with an axis of the first storage column 222 (as indicated as 236' in FIG. 2B). The shifter may be configured to register a capture plug (not shown) with an upper throat of the core catching tube 266, as further described hereinafter. While two shifters 234 and 236 are depicted in FIGS. 2A and 2B, the shifters may be omitted in some embodiments within the scope of the present disclosure. Further, any number of shifters may be provided in the core storage area 124 for moving core catching tubes or other components, such as separation or marking disks, sealing caps, etc.

A first transporter is provided for advancing cores from the coring bit 121 to the core catching tube 226 as it moves from a retracted position to an extended position. In the illustrated embodiment, the first transporter comprises a handling piston 240, such as a ball screw piston, which is positioned coaxially with respect to the first storage column 222 and is further coaxial with the coring bit 121 when the coring assembly 125 is in the eject position. The handling piston 240 comprises a brush 244, and also comprises a foot 242 sized to engage a majority of the cross-sectional area of a core or an outer diameter of the core. The handling piston 240 may be actuated to an extended position in which it passes through the bit and/or through the shifter 236 and partially into an opening of the core catching tube 226, thereby transporting a recently obtained core from the coring bit 121 to the core catching tube 226 located in the first storage column 222, and cleaning the coring bit inner bore for eventual debris.

A second transporter, such as lift piston 250, may be provided essentially coaxial with the second storage column 224 and configured to move from a retracted position to an extended position in which it passes through the shifter 234. As it moves to the extended position, the lift piston 250 may be used to engage sealing caps (not shown) with a core catching tube disposed in the second storage column 224, as further described hereinafter.

Figure 3:
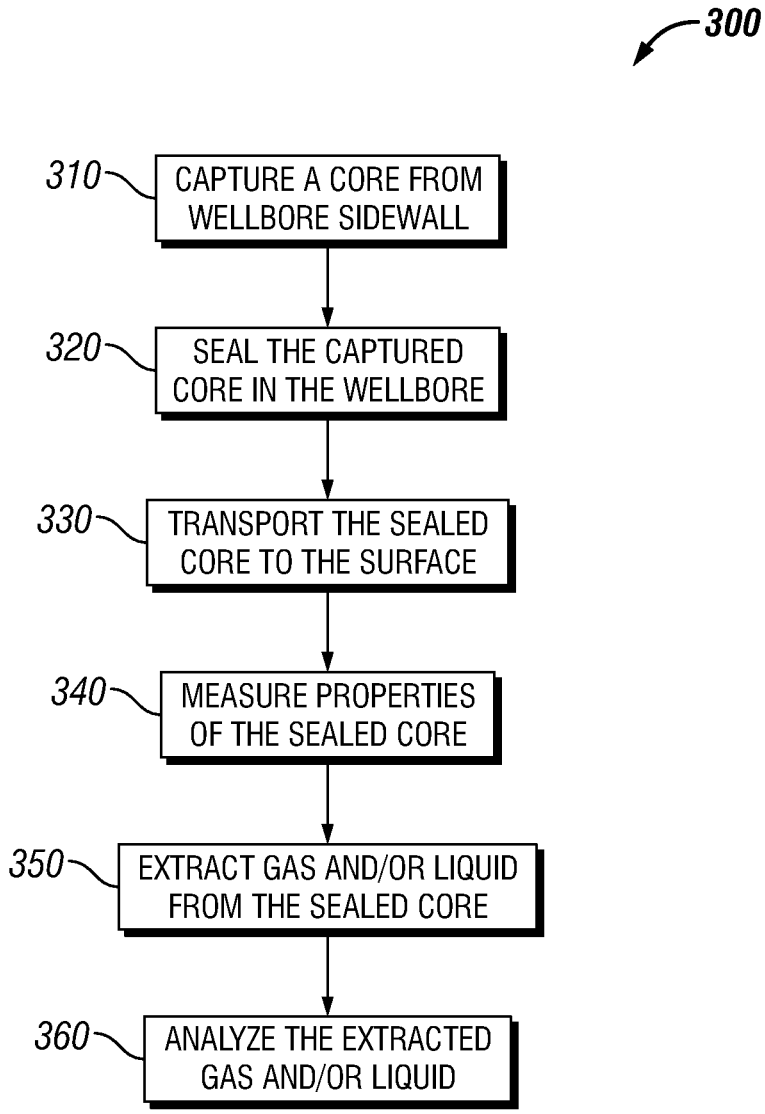
FIG. 3 is a flow-chart diagram of at least a portion of a method according to one or more aspects of the present disclosure.

FIG. 3 is a flow-chart diagram of at least a portion of a method 300 according to one or more aspects of the present disclosure. The method 300 may be performed with the tool 103 of FIGS. 1, 2A and 2B, among other tools within the scope of the present disclosure. It should be appreciated that the order of execution of the steps of the method 300 may be changed and/or some of the steps may be combined, divided, rearranged, omitted, eliminated and/or implemented in other ways within the scope of the present disclosure. In some cases, the method 300 may be used to obtain a sample of formation fluid present in the pores of formation core samples that would otherwise be difficult to obtain using a conventional sampling tool. For example, in tight gas reservoirs, or in heavy oil reservoirs, the mobility of the formation fluid may be low and conventional sampling of these reservoirs may be difficult.

At step 310, at least one core is captured from a wellbore sidewall. For example, the coring tool may be anchored in the wellbore at a location of interest. The coring assembly may be rotated into a coring position, and the coring bit may be extended into the adjacent formation. After the coring bit has penetrated the formation, the coring assembly may be further rotated to sever a core from the formation. The coring bit may be retracted into the coring assembly and the coring assembly may then be rotated into an eject position. A handling piston may be used to advance the recently obtained core into a core catching tube, and introduce the core through a throat of the core catching tube. The core catching tube may be filled with wellbore fluid, or may be filled with a gel disposed in the core catching tube prior to lowering the coring tool in the wellbore. As the core is inserted into the core catching tube, the fluid located in the core catching tube is displaced into the wellbore. For example, the core catching tube may include fluid passageways and/or ports to facilitate the evacuation of the fluid. One or more cores may be stored in the core catching tube. For example, an extension and rotation mechanism as described in U.S. Patent Application Pub. No. 2009/0025941, incorporated in its entirety herein by reference, may be used to collect a plurality of cores in a single formation layer.

At step 320, the captured core is sealed in the core catching tube, downhole. For example, the ports of the core catching tube may be sealed, such as further described hereinafter.

At step 330, the core sealed in the core catching tube is transported to the surface. The pressure in the core catching tube may be maintained, for example by using a cushion. As the core volume changes due to thermal expansion/contraction, and/or as the volume of the core catching tube expands under differential pressure, the pressure in the chamber may be kept at essentially the same level. At surface, the chamber may be detached from the coring tool and may be further secured for handling and/or transportation. For example, the chamber may be disposed in a DOT-approved pressure vessel. Alternatively, or additionally, breach locks disposed on the catching tube may be further secured by an operator.

At the well site, or in laboratory, properties of the sealed core may be measured at step 340. More specifically, the properties may be measured while the core is still encapsulated in the core catching tube. For example, at least a portion of the wall of the core catching tube may be configured to permit the transmission of a magnetic field, electromagnetic waves, and/or nuclear radiation therethrough. For example, the wall of the core catching tube may be made of polyether etherkethone, fiber reinforced resin (e.g., fiber reinforced epoxy). Thus, the properties of the core and/or the positions of separation or marking disks located in the core catching tube may be determined. Example of core evaluation methods and/or suitable materials for core catching tubes may be found in U.S. Pat. No. 7,500,388, incorporated in its entirety herein by reference.

At the well site or in a laboratory, gas and/or liquid may be extracted from the sealed core at step 350. For example, an access port of the core catching tube may be opened and fluidly connected to a bottle. Pressurized gas may then controllably leak into the bottle. Liquid may also be extracted. For example, the core catching tube may be disposed in a vessel, and a piston disposed in the core catching tube may be energized to compress the cores and extract fluid therefrom into the bottle. One example of such technique may be found in PCT Patent Application Pub. No. WO 2008/098359, incorporated in its entirety herein by reference.

At step 360, the extracted fluid (gas and/or liquid) may be analyzed to determine, for example, a composition of the fluid. In some cases, gas chromatography may be used to determine the composition of the extracted fluid.

Figure 4A:
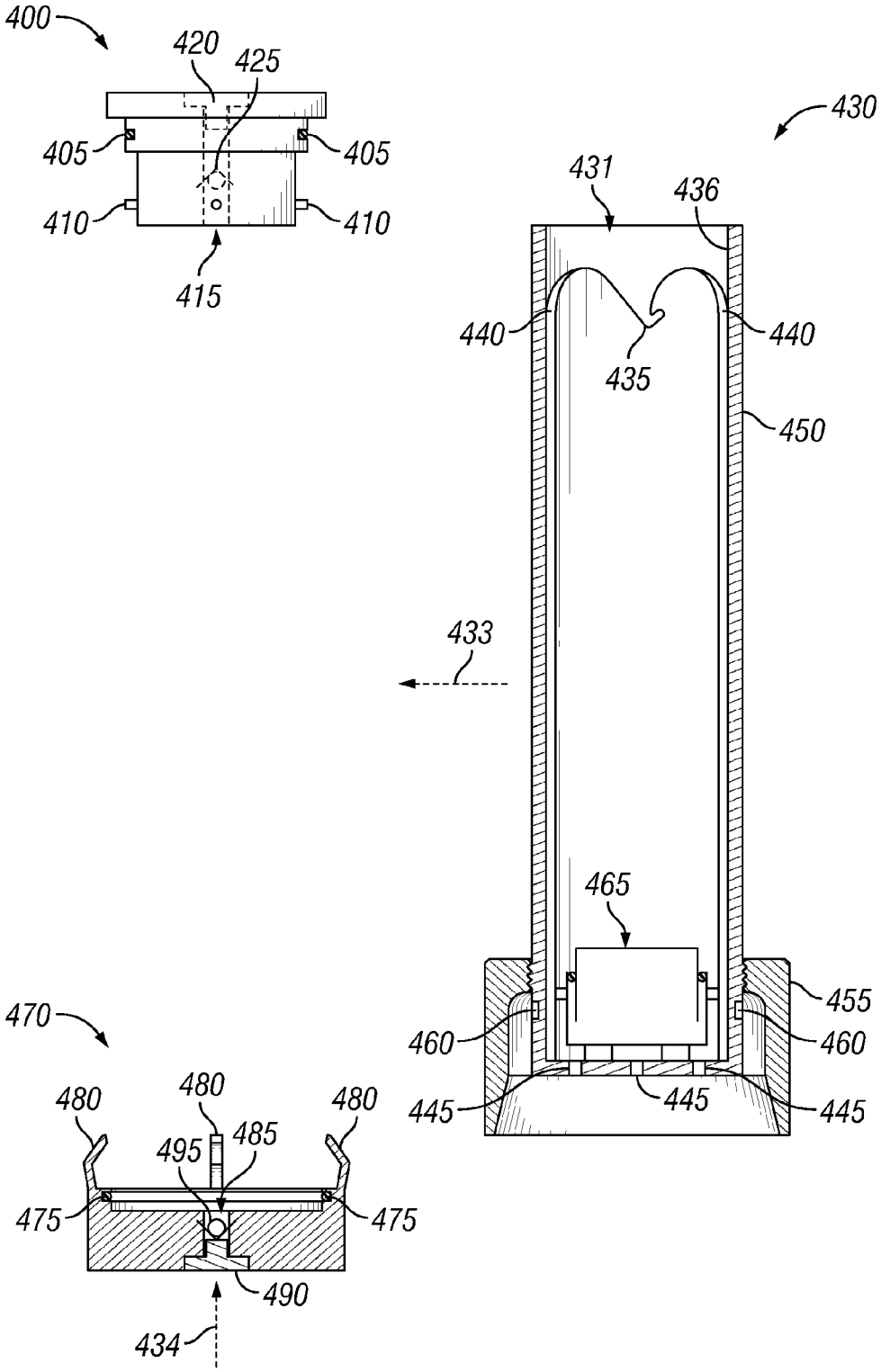
FIGS. 4A and 4B are schematic views of apparatus according to one or more aspects of the present disclosure.

FIG. 4A shows a core catching tube 430, a capture plug 400, and a lower cap 470 according to one or more aspects of the present disclosure. The core catching tube 430 may be used to implement the core catching tube 226 in FIGS. 2A and 2B.

The core catching tube 430 comprises a wall, such as a sleeve 450. The sleeve 450 may be made of any material suitable for downhole use, and may be adapted to withstand or bear internal pressure. In some cases, at least a portion of the sleeve 450 may be configured to permit the transmission of a magnetic field, electromagnetic waves, and/or nuclear radiation therethrough. For example, the sleeve 450 may be made of polyether etherkethone, fiber reinforced resin (e.g., fiber reinforced epoxy). The sleeve 450 comprises one or more slots 440 which may be configured to facilitate the circulation of a fluid (e.g., wellbore fluid, gel, etc.) present in the sleeve 450 as cores are advanced in the sleeve 450. The sleeve 450 may also comprise ports 445 configured to facilitate the evacuation of the fluid present in the sleeve 450 as cores are advanced in the sleeve 450 and/or as the capture plug 400 is inserted into the sleeve 450. The fluid may escape the sleeve 450 through at least one of an upper throat 431 of the core catching tube 430 and the ports 445. The core catching tube 430 may further comprise a cushion 465 (e.g., a nitrogen chamber pressurized at surface). The cushion 465 may be configured to reduce shocks to the cores during transportation and handling of the cores, and/or to maintain the pressure in the core catching tube 430 when the tube is sealed. Additionally, or alternatively, the cushion 465 may be configured to reduce its volume as the capture plug 400 and/or the lower cap 470 are partially inserted into the core catching tube 430, thereby facilitating the insertion.

The capture plug 400 comprises a plurality of breach lock pins 410, each configured to engage a guiding J-slot 435 of the sleeve 450. The capture plug 400 also comprises a seal 405 configured to engage a seal surface 436 of the sleeve 450. The seal 405 may be a radial seal, such as a stepped radial seal (as shown), configured to prevent cutting the seal during insertion of the capture plug 400. The seal 405 may also be a corner seal. The capture plug 400 may comprise a formation fluid passageway 415. The passageway 415 may comprise an access port plug 420, such as a quick-connect port. The passageway 415 may be provided with a check valve 425 configured to prevent pressure and/or fluid losses prior to inserting a sampling tube (not shown) in the access port.

The lower cap 470 comprises a plurality of retaining arms 480 each having a protrusion configured engage a crimp guide 455, such as may be affixed to the core catching tube 430, and to crimp on a groove 460 of the core catching tube 430. The lower cap 470 also comprises a seal 475, for example an O-ring or a gasket, configured to seal against an outer surface of the core catching tube 430. The lower cap 470 may comprise a formation fluid passageway 485. The passageway 485 may include an access port plug 490, such as a quick-connect port. The passageway 485 may be provided with a check valve 495 configured to prevent pressure and/or fluid losses prior to inserting a sampling tube (not shown) in the access port.

Example operation of the core catching tube 430, the capture plug 400, and the lower cap 470 is now described in reference to FIGS. 2A, 2B, 4A and 4B. The core catching tube 430 may be disposed in the first storage column 222. The capture plug 400 and the lower cap 470 may be disposed respectively at the bottom and top of the second storage column 224. The capture plug 400 and the lower cap 470 may be held in place with a retention device (not shown). The coring tool 103 may be used to acquire a plurality of cores 472 and store the cores in the core catching tube 430.

When desired, the obtained cores may be sealed in the wellbore. For example, one of the shifters 234 and/or 236 may be actuated to register or align the core catching tube 430 with the capture plug 400 and the lower cap 470 located in the second storage column 224, as indicated by the arrow 433. The lift piston 250 may be actuated to lift the lower cap 470 and the core catching tube 430, as indicated by the arrow 434. Consequently, the capture plug 400 is inserted into the upper throat 431 of the core catching tube 430. The seal 405 engages the sealing surface 436. Fluid in the sleeve 450 may still escape the coring chamber 430 through the ports 445. Also, the breach lock pins 410 are guided in the J-slots 435. In some cases, the capture plug 400 may be free to rotate with respect to the core catching tube 430. Thus, the breach lock pins 410 may secure the capture plug 400 on top of the core catching tube 430. Alternatively, the core catching tube 430 may be rotated at surface by an operator to insure proper securing of the capture plug 400 on the core catching tube 430. Further, the retaining arms 480 engage a clearance between the core catching tube 430 and the crimp guide 455. The retaining arms 480 are crimped and the protrusion at the distal ends thereof locks into the groove 460. The seal 475 engages an outer surface of the core catching tube 430, and prevents fluid in the sleeve 450 from escaping through the ports 445. Fluid trapped in the core catching tube may compress the cushion 465, therefore reducing the amount of force needed to move the lower cap 470 against the core catching tube 430. Thus, the cores 472 are sealed in the core catching tube 430.

The core catching tube 430, the capture plug 400, and the lower cap 470 may be conveyed to the surface by the coring tool 103. During transportation, volume changes may be compensated by the cushion 465, thereby maintaining the pressure in the core catching tube 430.

Figure 4B:
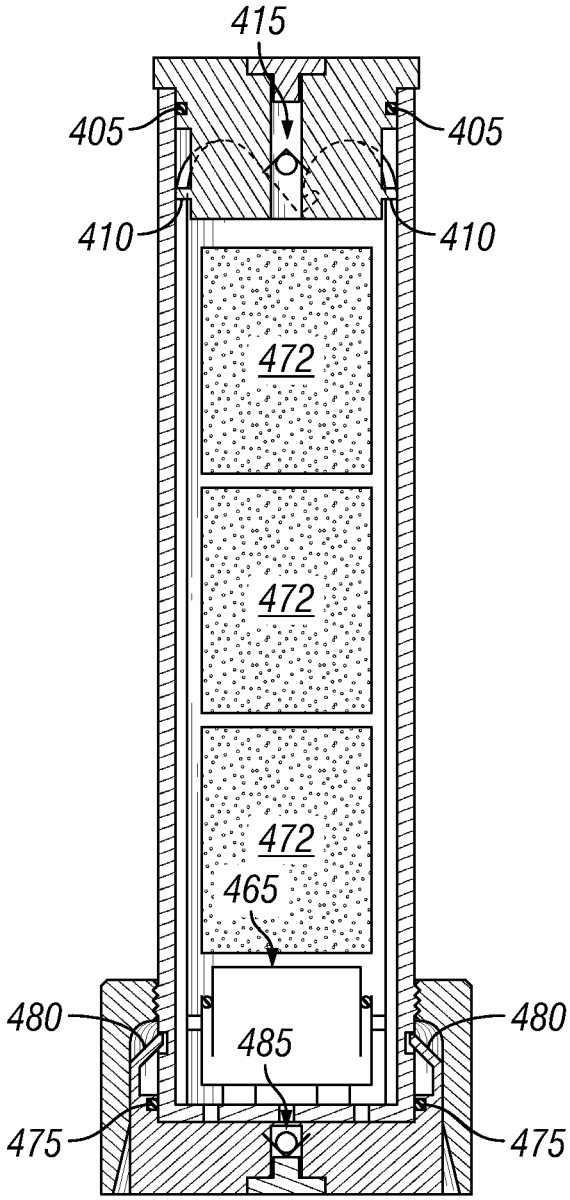

At surface, the core catching tube 430, the capture plug 400, and the lower cap 470 may be removed from the coring tool 103, as shown in FIG. 4B. One or more of the access ports 415 and/or 485 may then be opened to collect fluid (gas and/or liquid) from the coring chamber 430. The fluid may be collected in a pressurized bottle (not shown), and/or analyzed.

Figure 5:
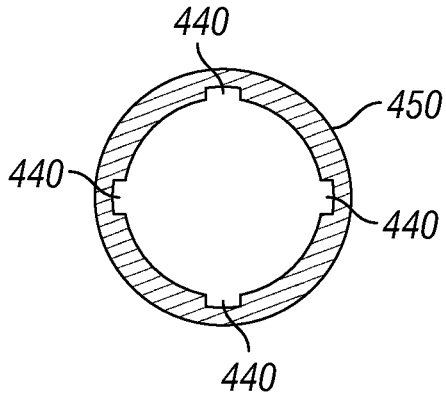
FIG. 5 is a schematic view of apparatus according to one or more aspects of the present disclosure.

FIG. 5 shows a horizontal cross section of the sleeve 250 shown in FIGS. 4A and 4B. One example design of the slots 440 is shown in greater detail.

Figure 6A:
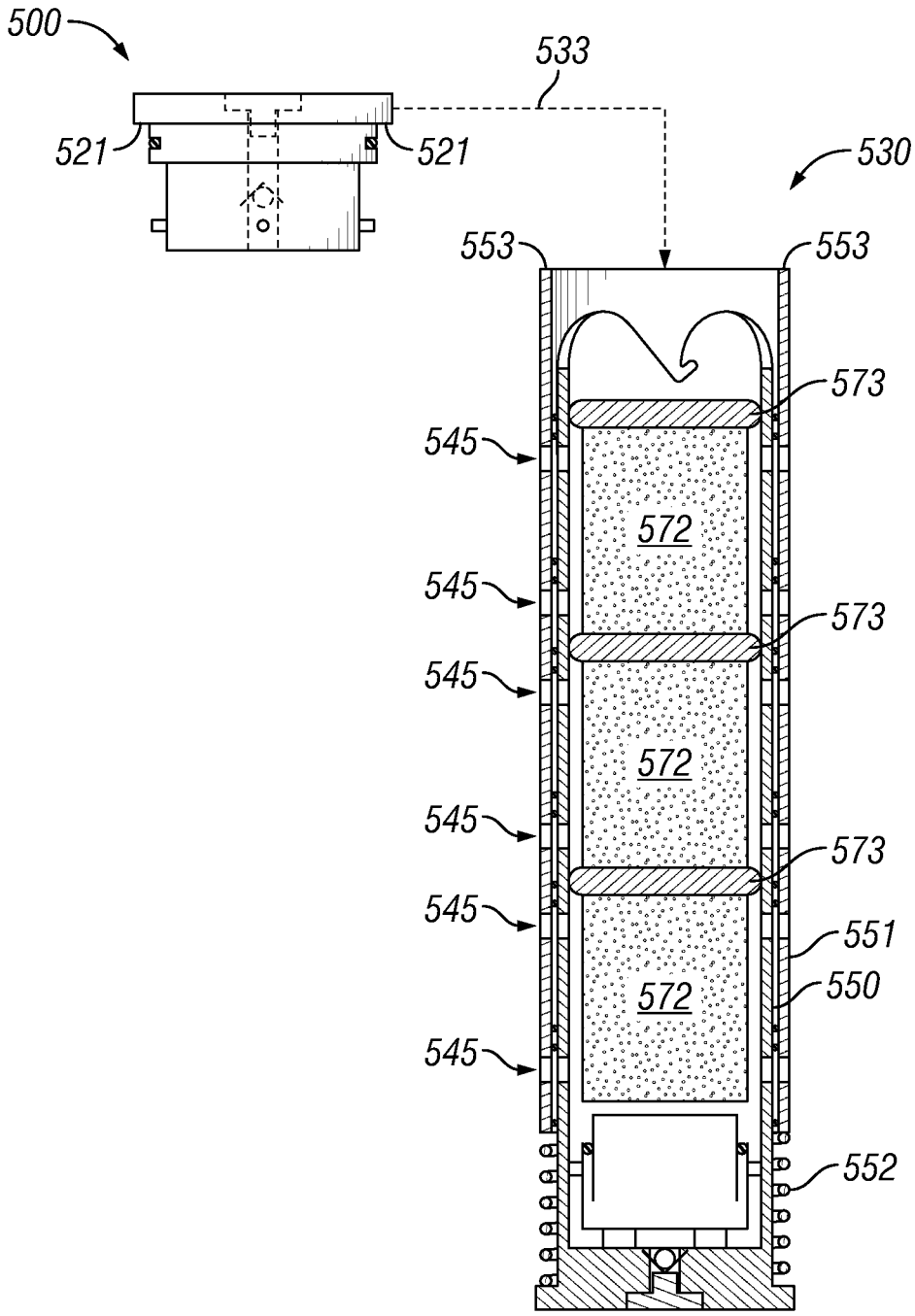
FIGS. 6A and 6B are schematic views of apparatus according to one or more aspects of the present disclosure.

FIG. 6A shows a capture plug 500 and a core catching tube 530 according to one or more aspects of the present disclosure. The capture plug 500 may be similar to the capture plug 400 of FIGS. 4A and 4B. In this example, however, the capture plug 500 includes a shoulder 521 configured to abut a corresponding shoulder 553 of the core catching tube 530.

The core catching tube 530 comprises a perforated sleeve 550 and an isolation sleeve 551. The isolation sleeve 551 is configured to reciprocate along the axis of the perforated sleeve 550. Seals, such as O-rings, may be provided therebetween. In a first position (as shown), apertures of the perforated sleeve 550 substantially align with apertures in the isolation sleeve 551 and cooperate to define ports 545. The ports 545 may be configured to facilitate the evacuation of the fluid located in the sleeve 550 as cores 572 are advanced in the perforated sleeve 550 and/or as the capture plug 500 is inserted into the isolation sleeve 551. The ports 545 may be maintained in an open position, such as by a spring 552. Thus, the ports 545 may be in a normally open position.

Example operation of the core catching tube 530 and the capture plug 500 is now described in reference to FIGS. 2A, 2B, 6A. A plurality of cores 572 are extracted from the formation and inserted into the core catching tube 530. Fluid located in the core catching tube 530 is evacuated through the ports 545. If desired, separation or marking disks 573 may be inserted between the cores. For example, the separation or marking disks 573 may be stored in the second storage column 224, and may be inserted in the core catching tube 530 using the shifter 236. A capture plug 500 may also be stored in the second storage column 224. As indicated by arrow 533, the capture plug 500 may be aligned with a throat of the core catching tube 530 using the shifter 236. Then the capture plug 500 may be inserted on the core catching tube 530 using the handling piston 240. The distance between the breach lock pins and the shoulder 521 is configured to lower the shoulder 533 and the isolation sleeve 551 by a sufficient amount so that the ports 545 close. Thus, the cores 573 are sealed in the core catching tube 530.

At surface, the location of separation or marking disks 573, among other things, may be detected by transmitting of a magnetic field, an electromagnetic waves, and/or a nuclear radiation through the sleeves 550 and 551 and measuring a transmitted quantity. Gas and/or liquid may be extracted from the sealed core catching tube as previously described.

Figure 6B:
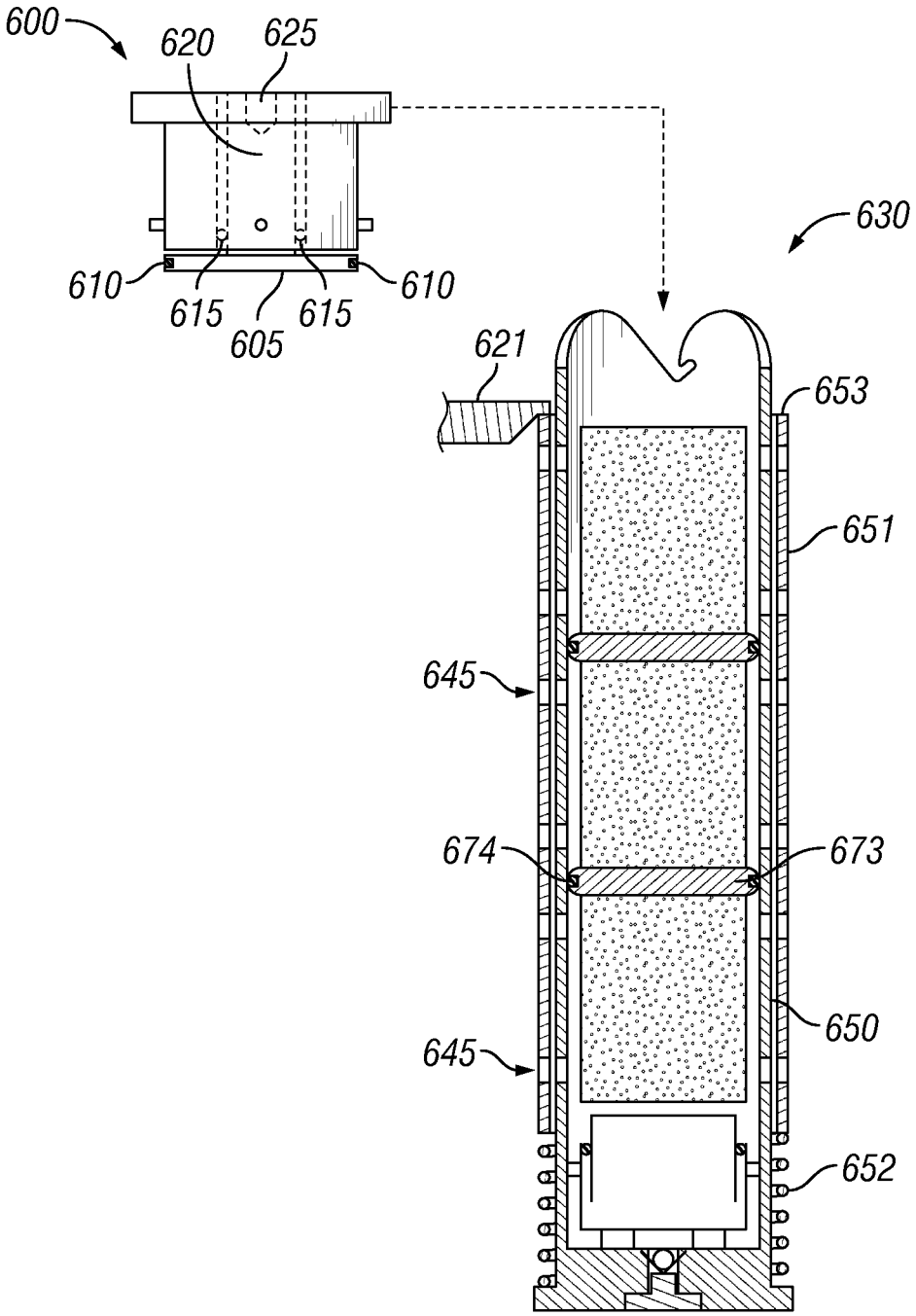

FIG. 6B shows a capture plug 600 and a core catching tube 630 according to one or more aspects of the present disclosure. The capture plug 600 and the core catching tube 630 may be used in lieu of the capture plug 500 and the core catching tube 530 of FIG. 6A.

The capture plug 600 is provided with a piston 605 having a seal 610 configured to engage the inner bore of the perforated sleeve 650. The piston 605 is affixed to a ram 620 extending through the length of the capture plug 600. The ram may include a threaded portion 625. A seal 615 is provided between the ram 620 and the body of the capture plug 600.

The core catching tube 630 is similar to the core catching tube 530 of FIG. 6A. However, the spring 652 is configured to maintain the plurality of ports 645 in a normally closed position. Further, the isolation sleeve 651 is configured to be recessed, so that an actuating mechanism 621, for example a fork, can be engaged against the shoulder 653. The actuating mechanism 621 may be moved in a down direction to open the ports 645. When desired, the ports 645 may be closed by releasing the force applied by the actuating mechanism 621.

The capture plug 600 and core catching tube 630 may be used similarly to the capture plug 500 and core catching tube 530. In addition, the piston 605 may be connected to a force member (not shown), such as via the threaded portion 625. The piston may be used to apply a force on the core samples and mechanically extract liquid and/or gas from the pores of the core samples. In some cases, separation or marking disks 673 may be placed between cores, or perhaps at least between cores extracted from different formations. The separation or marking disks 673 may include a seal 674 configured to engage the inner bore of the core catching tube 630. The location of separation or marking disks 673 may be detected as previously described. The relative position of the separation or marking disks 673 ports 645 may be determined. Thus, liquid and/or gas from cores between two disks 673 may be collected through a corresponding port 645.

Figure 7:
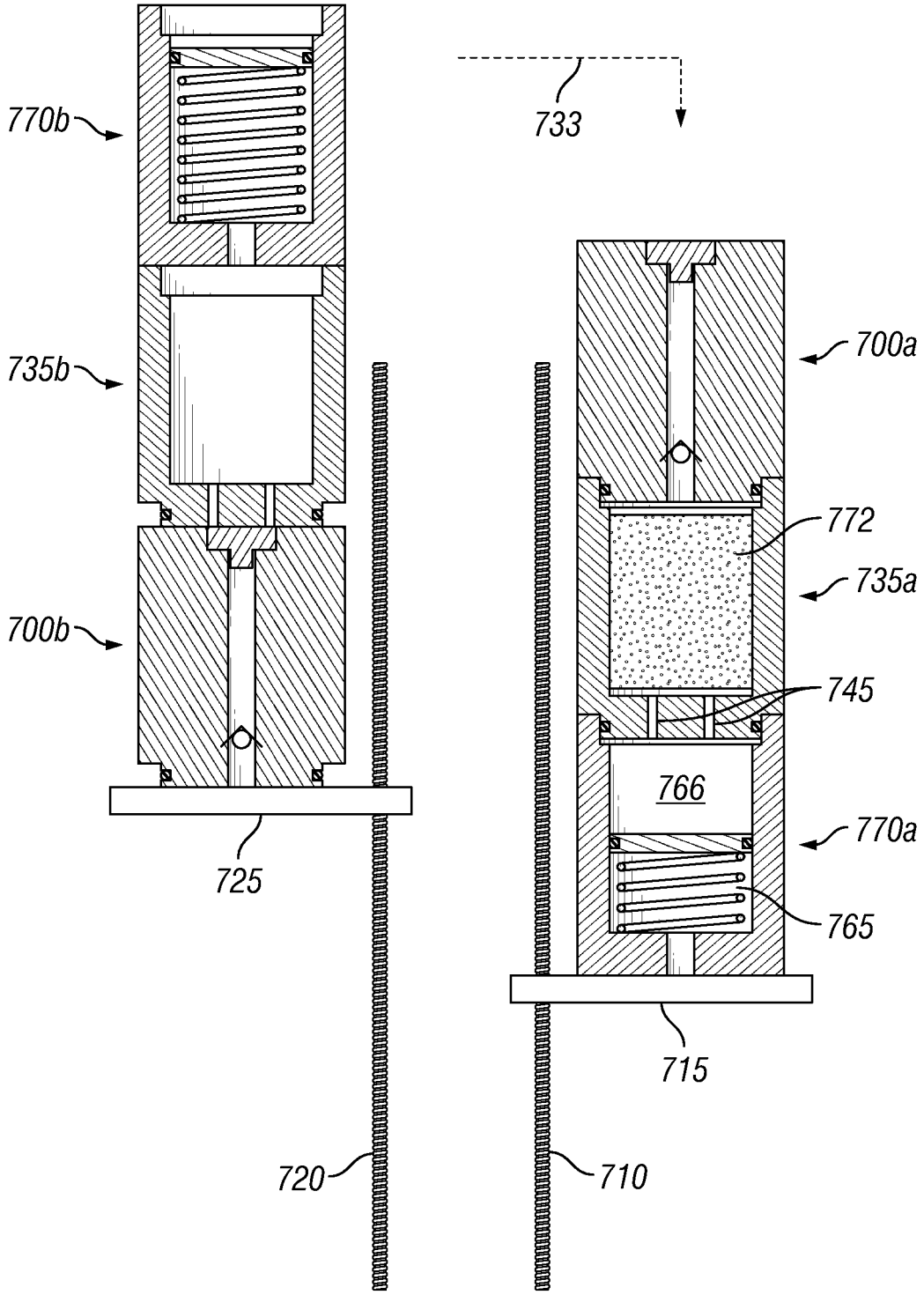
FIG. 7 is a schematic view of apparatus according to one or more aspects of the present disclosure.

FIG. 7 shows core holders 735*a*, 735*b*, capture plugs 700*a*, 700*b*, and lower caps 770*a*, 770*b* according to one or more aspects of the present disclosure. The embodiment illustrated in FIG. 7 may be used to store each individual core (such as core 772) in its own pressurized container.

The core lower caps 770*a* and 770*b* include a locking mechanism (not shown), such as a crimping device or a breach lock device, as previously described, configured to engage the core holders 735*a* and 735*b*, respectively. Further, the core holders 735*a* and 735*b* include a locking mechanism (not shown) configured to engage the capture plugs 700*a* and 700*b*, respectively.

The capture plugs 700*a* and 700*b* may include a sealed access port (such as a quick-connect port), and an optional actuated check valve as previously described. The core holders 735*a* and 735*b* include one or more ports 745 configured to facilitate the evacuation of the fluid present in the core holders 735*a* and 735*b* as cores are advanced in the core holders 735*a* and 735*b* and/or as the capture plug 700*a* and 700*b* are inserted into the core holders 735*a* and 735*b*. Further, the walls of the core holders 735*a* and 735*b* may include slots, as previously described. The core lower caps 770*a* and 770*b* include a cushion 765 for allowing fluid present in the core holders 735*a* and 735*b* to flow into a sealed chamber 766 as the capture plug 700*a* and 700*b* are inserted into the core holders 735*a* and 735*b*, thereby facilitating the insertion of the capture plugs.

Example operation is now described in reference to FIGS. 2A, 2B, and 7. A plurality of capture plugs, core holders, and lower caps may be stored in the second storage column 224. As shown, the plurality of capture plugs, core holders, and lower caps stored in the second storage column 224 may be stored in reverse order, thereby preventing interlocking therebetween. A lower cap, such as the lower cap 770*a*, may be lifted into a position in which it engages the shifter 236, for example using a lead screw 720 coupled to an elevator plate 725. As indicated by arrow 733, the shifter 236 is actuated to register the lower cap 770*a* with the first storage column 222, and the handling piston 240 is actuated to advance the lower cap 770*a* into the first storage column 222. A core holder, such as the core holder 735*a*, is then lifted into a position in which it engages the shifter 236, using the lead screw 720 and the elevator plate 725. The shifter 236 is actuated to register the core holder 735*a* with the first storage column 222. The coring assembly 125 is used to obtain a core 772. The handling piston 240 is extended to dispose the obtained core into the core holder 735*a*. The handling piston 240 is further extended to lock the lower cap 770*a* and the core holder 735*a*. A capture plug, such as the capture plug 700*a*, is then lifted into a position in which it engages the shifter 236, using the lead screw 720 and the elevator plate 725. The shifter 236 is actuated to register the capture plug 700*a* with the first storage column 222. The handling piston 240 is extended to lock the core holder 735*a* and the capture plug 700*a*. During operation, the elevator plate 715 may be lowered as desired, for example using a lead screw 710. More cores may then be captured in a similar fashion.

Figure 8:
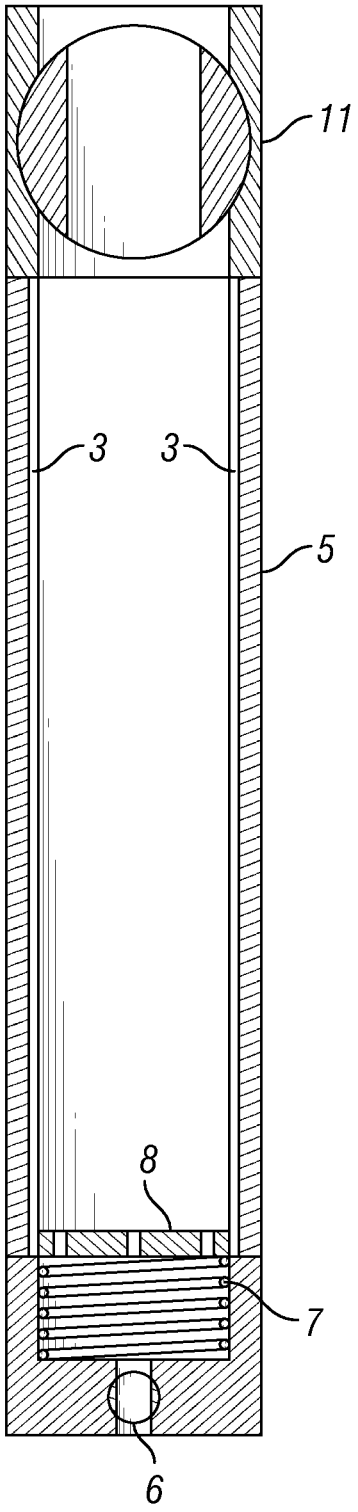
FIG. 8 is a schematic view of apparatus according to one or more aspects of the present disclosure.

FIG. 8 shows an alternate aspect of the present disclosure. This aspect may be implemented using the coring tool 103 of FIGS. 2A and 2B. Alternatively, this aspect may be implemented using other coring tools, such as the coring tools described in U.S. Pat. Nos. 4,714,119 and/or 5,667,025, incorporated in their entirety herein by reference.

In this aspect, a pressure bearing core catching tube 5 is provided within a storage section of a coring tool, although some portions may be in the coring section. The core catching tube 5 may be a solid, un-perforated tube, a portion of which having a plurality of slots 3. The lower head of the core catching tube 5 may include a bottom isolation valve 6. The bottom isolation valve 6 may be a ball valve, a gate valve, or any other pressure bearing fluid valve. In an open position, the bottom isolation valve 6 may allow mud or other fluid to be ejected from the core catching tube 5 as cores are inserted therein. In a closed position, the bottom isolation valve 6 may hydraulically isolate the core catching tube 5, such as once the tube is filled and/or upon a command to the coring tool initiated by a surface operator. A perforated core support 8 may be installed above the bottom isolation valve 6, such as to insure mechanical integrity of the core samples in the core catching tube 5. Optionally, a spring or fluid cushion 7 may be provided to reduce the mechanical shock seen while acquiring and/or conveying the cores. The spring or fluid cushion 7 may be beneficial to preserve the mechanical integrity of the samples. In addition, separation/marking disks (not shown) may be inserted in the core catching tube 5 between stored cores. Further, the core catching tube 5 is provided with a throat isolation valve 11. The throat isolation valve 11 may be a large ball valve, or a sliding gate valve. In some cases, the bottom isolation valve 6 and the throat isolation valve 11 are detachably coupled to a valve actuating mechanism (not shown) disposed in the body of the coring tool.

In operation, the core catching tube 5 is filled with one or more cores. The bottom isolation valve 6 is closed. The upper throat of the core catching tube 5 may also be sealed using the throat isolation valve 11. The core catching tube 5 is brought to the Earth's surface. The core catching tube 5, the bottom isolation valve 6, and the throat isolation valve 11 may be detached from the coring tool. The bottom isolation valve 6 may be coupled to a surface actuating mechanism. The bottom isolation valve 6 may be opened and fluid (gas and/or liquid) may be extracted from the core catching tube 5.

In view of all of the above, those skilled in the art should recognize that the present disclosure introduces an apparatus comprising: a sidewall coring tool configured to obtain a plurality of sidewall formation cores from a sidewall of a wellbore extending into a subterranean formation, wherein the sidewall coring tool comprises: a core catching tube configured to store the plurality of sidewall formation cores therein, wherein the core catching tube comprises a fluid port configured to allow evacuation of fluid from the core catching tube as each of the plurality of sidewall formation cores is introduced therein, and wherein the core catching tube, including the fluid port, is configured to be sealed downhole without removing the sidewall coring tool from the wellbore. The core catching tube may comprise a cushion configured to maintain a pressure in the core catching tube once the fluid port is sealed downhole. The cushion may comprise a mechanical spring. At least a portion of the core catching tube may be configured to pass energy therethrough to the plurality of sidewall formation cores therein. The core catching tube may comprise a slot configured to open and close, thus allowing further evacuation of fluid from the core catching tube when the slot is opened. The sidewall coring tool may further comprise a capture plug configured to couple with an end of the core catching tube, thus contributing to sealing of the plurality of sidewall formation cores in the core catching tube. The capture plug may comprise an access port in fluid communication with a fluid passageway that opens into the core catching tube. The capture plug may comprise a breach lock pin configured to engage a corresponding feature of the core catching tube. The sidewall coring tool may further comprise a cap configured to couple with another end of the core catching tube, thus contributing to sealing of the plurality of sidewall formation cores in the core catching tube. The cap may comprise an access port in fluid communication with a fluid passageway that opens into the core catching tube. The cap may comprise a retaining arm configured to mate with a guide of the core catching tube. The core catching tube may comprise an inner sleeve and an outer sleeve concentric with the inner sleeve, wherein the inner and outer sleeves comprise corresponding slots configured to align in response to relative movement of the inner and outer sleeves, and when aligned the slots of the inner and outer sleeves allow further evacuation of fluid from the core catching tube as each additional one of the plurality of sidewall formation cores is inserted into the core catching tube. The core catching tube may further comprise a plurality of separators each configured to interpose and hydraulically isolate neighboring ones of the plurality of sidewall formation cores.

The present disclosure also introduces a method comprising: obtaining, with a sidewall coring tool positioned in a wellbore extending into a subterranean formation, a sidewall core from a sidewall of the wellbore; moving the sidewall core into a core catching tube of the sidewall coring tool, wherein moving the sidewall core into the core catching tube displaces a fluid in the core catching tube through a port in the core catching tube; sealing the core in the core catching tube, including the port, while the sidewall coring tool is in the wellbore; and removing the sidewall coring tool, including the core sealed in the core catching tube of the sidewall coring tool, from the wellbore. The method may further comprise anchoring the sidewall coring tool in the wellbore prior to obtaining the sidewall core. Moving the sidewall core into the core catching tube may displace a fluid in the core catching tube through a plurality of closable openings in the core catching tube. Removing the sidewall coring tool from the wellbore may comprise maintaining a constant pressure in the core catching tube. The method may further comprise detaching the core catching tube from the sidewall coring tool after removing the sidewall coring tool from the wellbore. The method may further comprise securing breach locks on the core catching tube after removing the sidewall coring tool from the wellbore. The method may further comprise measuring a property of the core while the core is sealed in the core catching tube. Measuring the property of the core may comprise transmitting energy into the sealed core through the core catching tube.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a sidewall coring tool configured to obtain a plurality of sidewall formation cores from a sidewall of a wellbore extending into a subterranean formation, wherein the sidewall coring tool comprises:

a core catching tube configured to store the plurality of sidewall formation cores therein, wherein the core catching tube comprises a fluid port configured to allow evacuation of fluid from the core catching tube as each of the plurality of sidewall formation cores is introduced therein, and wherein the core catching tube, including the fluid port, is configured to be sealed downhole;

a capture plug configured to couple with an end of the core catching tube, thus contributing to sealing of the plurality of sidewall formation cores in the core catching tube; and a cap configured to couple with another end of the core catching tube, thus contributing to sealing of the plurality of sidewall formation cores in the core catching tube.

2. The apparatus of claim 1 wherein the core catching tube comprises a cushion configured to maintain a pressure in the core catching tube once the fluid port is sealed downhole.

3. The apparatus of claim 2 wherein the cushion comprises a mechanical spring.

4. The apparatus of claim 1 wherein at least a portion of the core catching tube is configured to pass energy therethrough to the plurality of sidewall formation cores therein.

5. The apparatus of claim 1 wherein the core catching tube comprises a slot configured to open and close, thus allowing further evacuation of fluid from the core catching tube when the slot is opened.

6. The apparatus of claim 1 wherein the capture plug comprises an access port in fluid communication with a fluid passageway that opens into the core catching tube.

7. The apparatus of claim 1 wherein the capture plug comprises a breach lock pin configured to engage a corresponding feature of the core catching tube.

8. The apparatus of claim 1 wherein the cap comprises an access port in fluid communication with a fluid passageway that opens into the core catching tube.

9. The apparatus of claim 8 wherein the cap comprises a retaining arm configured to mate with a guide of the core catching tube.

10. The apparatus of claim 1 wherein the core catching tube comprises a plurality of separators each configured to interpose and hydraulically isolate neighboring ones of the plurality of sidewall formation cores.

11. A method, comprising:

obtaining, with a sidewall coring tool positioned in a wellbore extending into a subterranean formation, a sidewall core from a sidewall of the wellbore;

moving the sidewall core into a core catching tube of the sidewall coring tool, wherein moving the sidewall core into the core catching tube displaces a fluid in the core catching tube through a port in the core catching tube;

sealing, by coupling a capture plug to a first end of the core catching tube and a cap to a second end of the core catching tube, the core in the core catching tube, including the port, while the sidewall coring tool is in the wellbore; and removing the sidewall coring tool, including the core sealed in the core catching tube of the sidewall coring tool, from the wellbore.

12. The method of claim 11 further comprising anchoring the sidewall coring tool in the wellbore prior to obtaining the sidewall core.

13. The method of claim 11 wherein removing the sidewall coring tool from the wellbore comprises maintaining a constant pressure in the core catching tube.

14. The method of claim 11 further comprising detaching the core catching tube from the sidewall coring tool after removing the sidewall coring tool from the wellbore.

15. The method of claim 11 further comprising securing breach locks on the core catching tube after removing the sidewall coring tool from the wellbore.

16. The method of claim 11 further comprising measuring a property of the core while the core is sealed in the core catching tube.

17. The method of claim 16 wherein measuring the property of the core comprises transmitting energy into the sealed core through the core catching tube.

18. An apparatus, comprising:

a sidewall coring tool configured to obtain a plurality of sidewall formation cores from a sidewall of a wellbore extending into a subterranean formation, the sidewall coring tool having a core catching tube disposed therein to store the plurality of sidewall formation cores, wherein the core catching tube comprises:

a fluid port configured to allow evacuation of fluid from the core catching tube as each of the plurality of sidewall formation cores is introduced therein, wherein the core catching tube, including the fluid port, is configured to be sealed downhole; and a plurality of separators each configured to interpose and hydraulically isolate neighboring ones of the plurality of sidewall formation cores.

19. An apparatus, comprising:

a sidewall coring tool configured to obtain a plurality of sidewall formation cores from a sidewall of a wellbore extending into a subterranean formation, the sidewall coring tool having a core catching tube disposed therein to store the plurality of sidewall formation cores, wherein the core catching tube comprises:

a fluid port configured to allow evacuation of fluid from the core catching tube as each of the plurality of sidewall formation cores is introduced therein, wherein the core catching tube, including the fluid port, is configured to be sealed downhole; and a cushion configured to maintain a pressure in the core catching tube once the fluid port is sealed downhole, wherein the cushion comprises a mechanical spring.

20. The apparatus of claim 19, wherein the core catching tube comprises a slot configured to open and close, thus allowing further evacuation of fluid from the core catching tube when the slot is opened.

* * * * *